US006336784B1

(12) United States Patent
Monaghan

(10) Patent No.: US 6,336,784 B1
(45) Date of Patent: Jan. 8, 2002

(54) FRAME LEVELING SPEED CONTROL SYSTEM FOR AN EXTENDIBLE BOOM VEHICLE

(75) Inventor: Merrick O. Monaghan, Yankton, SD (US)

(73) Assignee: Gehl Company, West Bend, WI (US)

( * ) Notice: Subject to any disclaimer, the term of this patent is extended or adjusted under 35 U.S.C. 154(b) by 0 days.

(21) Appl. No.: 09/146,581

(22) Filed: Sep. 3, 1998

(51) Int. Cl.[7] ..... B66C 23/00
(52) U.S. Cl. ..... 414/685; 180/272; 280/6.154
(58) Field of Search ..... 414/680, 685; 280/6.154, 5.501; 180/271, 272; 298/22 C

(56) References Cited

U.S. PATENT DOCUMENTS

| | | | | |
|---|---|---|---|---|
| 3,572,531 A | * | 3/1971 | Ulinski | |
| 3,796,336 A | * | 3/1974 | Ratliff | |
| 4,664,218 A | * | 5/1987 | Graham et al. | 180/272 |
| 5,188,248 A | | 2/1993 | Dohnalik | 212/189 |
| 5,639,119 A | * | 6/1997 | Plate et al. | 280/6.154 |
| 5,813,697 A | * | 9/1998 | Bargenquast et al. | 280/6.154 |

FOREIGN PATENT DOCUMENTS

| | | | | |
|---|---|---|---|---|
| JP | 4-19241 | * | 1/1992 | 298/22 C |

* cited by examiner

*Primary Examiner*—Gregory A. Morse
(74) *Attorney, Agent, or Firm*—Andrus, Sceales, Starke & Sawall, LLP

(57) ABSTRACT

A vehicle, such as an extendible forklift, includes a chassis or frame carrying a set of ground-engaging wheels, and a boom assembly pivotably mounted to the frame. A leveling cylinder is interposed between the frame and the wheels for leveling the frame when the vehicle is on uneven terrain and prior to raising the boom assembly to elevate a load. A switch mechanism is interposed between the frame and the boom assembly, for detecting when the boom assembly reaches or exceeds a predetermined angle relative to the frame. Actuation of the switch mechanism results in a restriction in the flow of fluid to the leveling cylinder, to reduce the speed at which the frame leveling cylinder can be operated. Simultaneously, the switch mechanism is operable to actuate the parking brake of the forklift, to prevent movement when the boom is raised above the predetermined angle. In this manner, frame leveling can only be accomplished at a slow speed when the boom assembly is at or above a predetermined angle relative to the frame.

24 Claims, 5 Drawing Sheets

FRAME LEVELING SPEED CONTROL SYSTEM FOR AN EXTENDIBLE BOOM VEHICLE

BACKGROUND AND SUMMARY OF THE INVENTION

This invention relates to boom-type vehicles, and more particularly to a frame leveling speed control arrangement for a boom-type vehicle.

A boom-type vehicle such as an extendible boom forklift typically includes a boom pivotably mounted to a frame. Hydraulic cylinders are interposed between the boom and the frame for moving the boom between its raised and lowered positions. The frame carries a set of wheels, and one or more frame leveling cylinders are interposed between the frame the wheels for leveling the frame when it is desired to raise the boom.

It is an object of the present invention to provide a system for insuring that a brake is applied when the boom reaches a predetermined angle relative to the frame. It is a further object of the invention to provide relatively slow movement of the frame leveling cylinder when the boom reaches a predetermined position relative to the frame. A still further object of the invention is to provide a system for preventing movement of the vehicle and for providing controlled movement of the frame leveling cylinder when the boom attains a predetermined angle relative to the frame.

In accordance with one aspect of the invention, a boom-type vehicle includes a frame carrying a set of ground-engaging wheels, and a frame leveling arrangement interposed between the frame and the wheels for leveling the frame relative to the ground. A boom is pivotably mounted to the frame, and a position sensing arrangement is interposed between the boom and the frame for sensing the angle of the boom relative to the frame. The frame leveling arrangement includes a leveling speed control responsive to the position sensing arrangement for enabling the leveling arrangement to operate at a first speed of operation when the angle of the boom relative to the frame is below a predetermined threshold, and to operate at a second speed of operation less than the first speed when the angle of the boom relative to the frame is above the predetermined threshold. A hydraulic cylinder arrangement is preferably interconnected between the boom and the frame for providing pivoting movement of the boom relative to the frame. The position sensing arrangement may be in the form of a movable member interconnected with the boom and movable in response to the movement of the boom relative to the frame, and a sensing member mounted to a portion of the cylinder arrangement interconnected with the frame, such that the position of the movable member relative to the sensing member changes according to the angle of the boom relative to the frame. The movable member may be in the form of a rod having a first end pivotably interconnected with the boom and a second end spaced therefrom. The sensing member may be in the form of a proximity switch operable to detect the second end of the rod when the angle of the boom relative to the frame reaches the predetermined threshold. The frame leveling arrangement may be in the form of a hydraulic cylinder arrangement interconnected between the frame and the wheels. The leveling speed control features a shiftable flow restricting arrangement interconnected with the hydraulic cylinder arrangement. The shiftable flow restricting arrangement may be in the form of a flow restrictor in the flow path of the hydraulic frame leveling cylinder arrangement and a check valve which is shiftable in response to actuation of the proximity switch to direct fluid flow through the flow restrictor when the angle of the boom relative to the frame reaches the predetermined threshold.

In accordance with another aspect of the invention, a boom-type vehicle includes a frame carrying a set of ground-engaging wheels, and a brake mechanism interconnected with the wheels for selectively preventing rotation of the wheels relative to the frame. A frame leveling arrangement is interposed between the frame and the wheels for leveling the frame relative to the ground. A boom is pivotably mounted to the frame, and a position sensing arrangement is interposed between the boom and the frame for sensing the angle of the boom relative to the frame. A brake actuator is responsive to the position sensing arrangement for automatically applying the brake mechanism when the angle of the boom relative to the frame exceeds a predetermined threshold. The position sensing arrangement is preferably as summarized above, and the brake actuator is responsive to actuation of the proximity switch for automatically applying the brake mechanism.

In a particularly preferred embodiment, the position sensing arrangement is interconnected with both the brake actuator and the leveling speed control arrangement. In this manner, the brake mechanism is automatically applied when the boom attains a predetermined angle relative to the frame and, simultaneously, the leveling speed control arrangement is operable to restrict fluid flow to and from the frame leveling cylinder arrangement for reducing the speed of operation of the frame leveling cylinder arrangement. This combination of automatic brake actuation and leveling speed control insures that the vehicle remains stationary and the frame can only be leveled at a relatively slow speed when the boom is at or above a certain angle relative to the frame.

The invention also contemplates a method of operating a boom-type vehicle, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
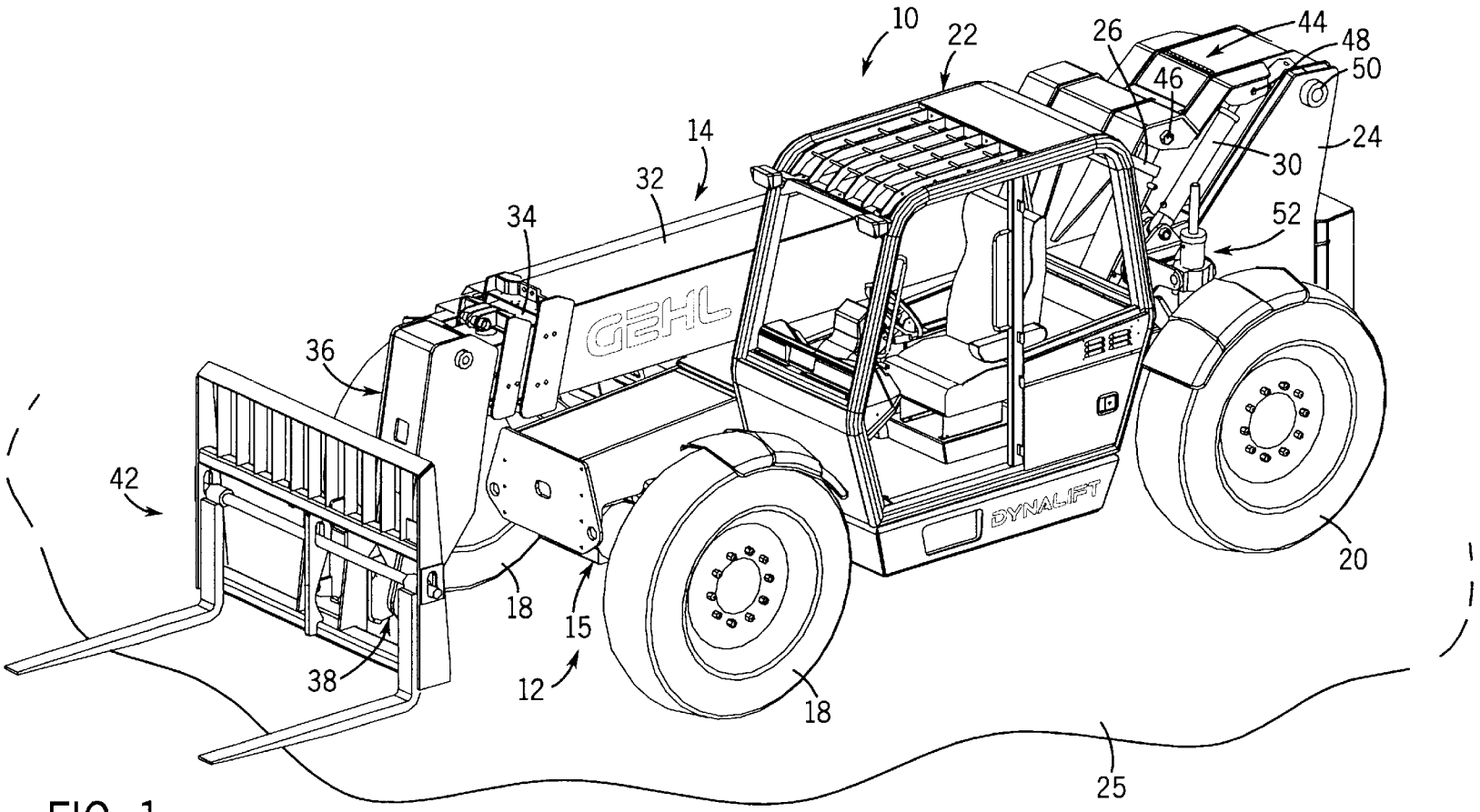
FIG. 1 is an isometric view of a boom-type vehicle, in the form of an extendible boom forklift, incorporating the subject matter of the present invention.

Referring to FIG. 1, a vehicle in the form of an extendible boom forklift 10 generally includes a frame or chassis 12 and a boom assembly 14 mounted to chassis 12. Chassis 12 includes a central frame member 15 extending in a longitudinal front-rear direction. A pair of front ground-engaging wheels are carried by a front axle assembly mounted toward the forward end of central frame member 15, and a pair of rear ground-engaging wheels 20 are mounted toward the rearward end of central frame member 15. A cab 22 is mounted between front wheels 18 and rear wheels 20 on one side of central frame member 15, and a drive train is mounted on the side of central frame member 15 opposite cab 22.

A pair of uprights 24 are mounted to central frame member 15 toward its rearward end, rearwardly of cab 22 and wheels 20. A pair of lift cylinders 26 are located one on either side of frame 16, and each lift cylinder 26 is connected to chassis 12 via a pivot connection which pivotably secures the cylinder end of the lift cylinder 26 to chassis 12 for movement about a substantially horizontal pivot axis. A pair of slave cylinders 30 are also located one on either side of chassis 12, and the cylinder end of each slave cylinder 30 is connected to chassis 12 via a pivot connection which provides pivoting movement of the slave cylinder 30 about a substantially horizontal pivot axis.

Boom assembly 14 generally includes an outer boom member 32 and an intermediate boom member 34 which is received within an internal passage defined by outer boom member 32 for telescoping inward and outward movement relative to outer boom member 32. Boom assembly 14 further includes an inner boom member received within an internal passage defined by intermediate boom member 34 and mounted for axial inward and ouward telescoping movement relative to intermediate boom member 34. A nose section 36 is mounted to the forward end of the inner boom member, and is located forwardly of the forward end of chassis 12. A drive arrangement provides inward and outward movement of intermediate boom member 34 and the inner boom member to which nose section 36 is mounted, in a manner as is known.

A tool mounting assembly 38 is pivotably mounted to the lower end of nose section 36, and a tilt cylinder (not shown) is interposed between nose section 36 and tool mounting assembly 38. Tool mounting assembly 38 includes an arrangement for releasably engaging a tool with boom assembly 14 through nose section 36. As shown in the drawings, the tool is in the form of a fork assembly 42, although it is understood that any other tool as desired can be mounted to tool mounting assembly 38.

Boom assembly 14 includes a mounting structure 44 toward its rearward end. Lift cylinder 26 is engaged with mounting structure 44 via a pivot connection 46, and slave cylinder 30 is connected to mounting structure 44 via a pivot connection 48. A pivot shaft 50 is operable to pivotably mount boom assembly 14 to uprights 24 through mounting structure 44. Boom assembly 14 is pivotable about a pivot axis defined by the longitudinal axis of pivot shaft 50.

With the arrangement as described above, boom assembly 14 is operable to lift a load located forwardly of chassis 12 utilizing the tool, such as fork assembly 42, mounted to the forward end of boom assembly 14 forwardly of front wheels 18. Extension of lift cylinders 26 functions to pivot boom assembly 14 upwardly about pivot shaft 50 to lift the load carried by the tool, such as fork assembly 42, and likewise retraction of cylinders 26 functions to lower the load by allowing boom assembly 14 to pivot downwardly about pivot shaft 50.

In a manner as is known, the rear axle assembly, to which rear wheels 20 are mounted, is pivotable relative to central frame member 15 to provide oscillating movement of wheels 20 relative to chassis 12 as forklift 10 travels over uneven terrain. A stabilizing cylinder assembly 52 is interposed between central frame member 15 and the rear axle assembly, to cushion shocks which would otherwise be experienced by central frame member 15 and the components mounted thereto, such as cab 22 and boom assembly 14, during such oscillating movement of wheels 20 relative to central frame member 15. In FIG. 1, stabilizing cylinder 52 is shown as being located at the left side of forklift 10.

In a similar manner, the front axle assembly, to which front wheels 18 are mounted, is pivotable relative to central frame member 15 to provide oscillating movement of wheels 18 as forklift 10 travels over uneven terrain. A frame leveling cylinder (not shown) in FIG. 1 is located at the right side of forklift 10 and is interconnected between central frame member 15 and the front axle assembly. In a manner as is known, the frame leveling cylinder is utilized to level chassis 12 relative to wheels 18 and 20 when forklift 10 is parked on uneven terrain and boom assembly 14 is to be raised and extended to place a load carried by fork assembly 42 onto an elevated surface. In accordance with a conventional operation, stabilizing cylinder 52 is automatically locked in position upon actuation of the frame leveling cylinder to fix the position of rear wheels 20 relative to central frame member 15, and operation of the leveling cylinder, located between the front axle assembly and central frame member 15, is operable to move chassis 12 to a level position.

Figure 2:
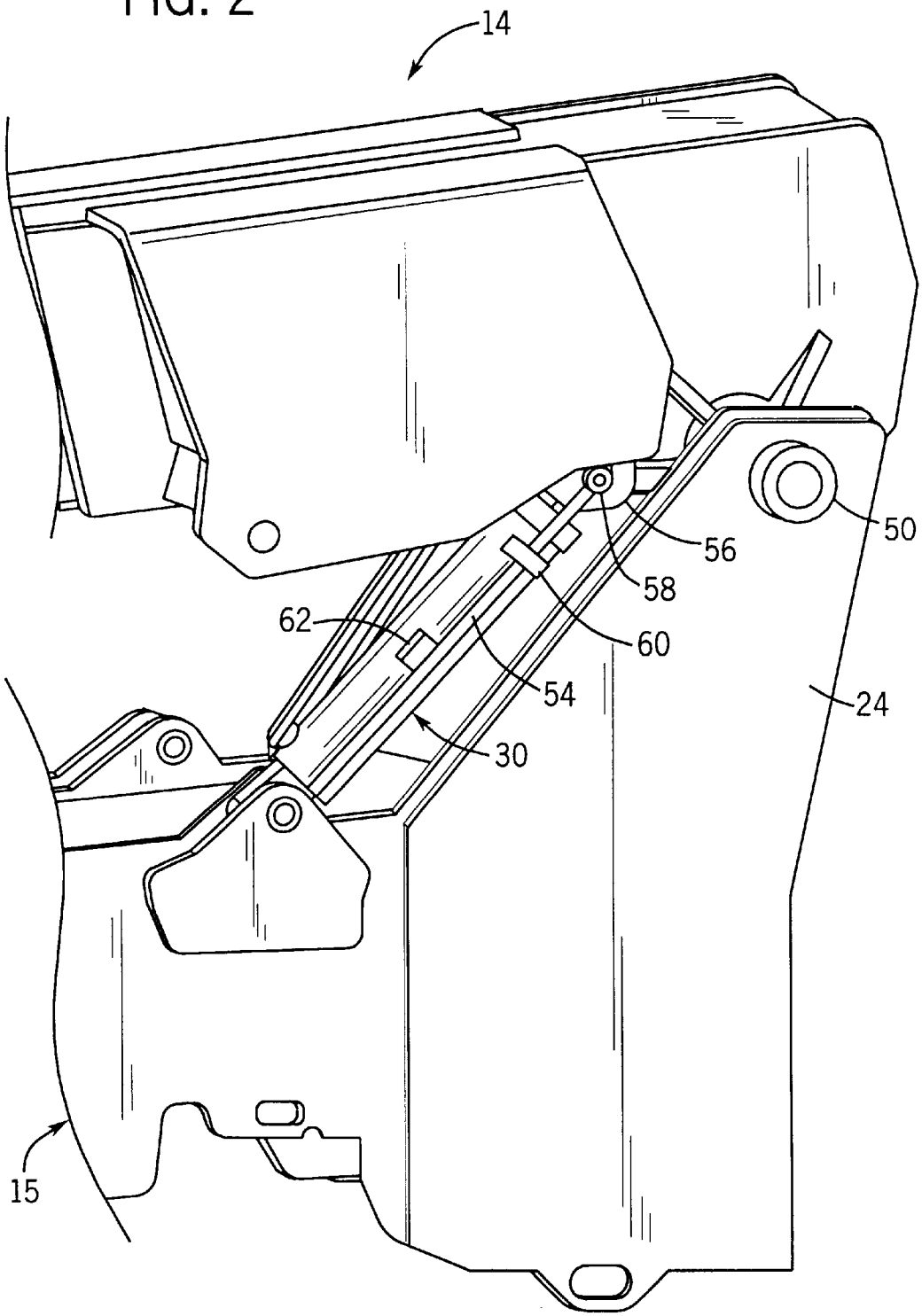
FIG. 2 is a partial isometric view showing the upper rear end of the boom-type vehicle of FIG. 1, with the boom in a lowered position relative to the frame.
Figure 3:
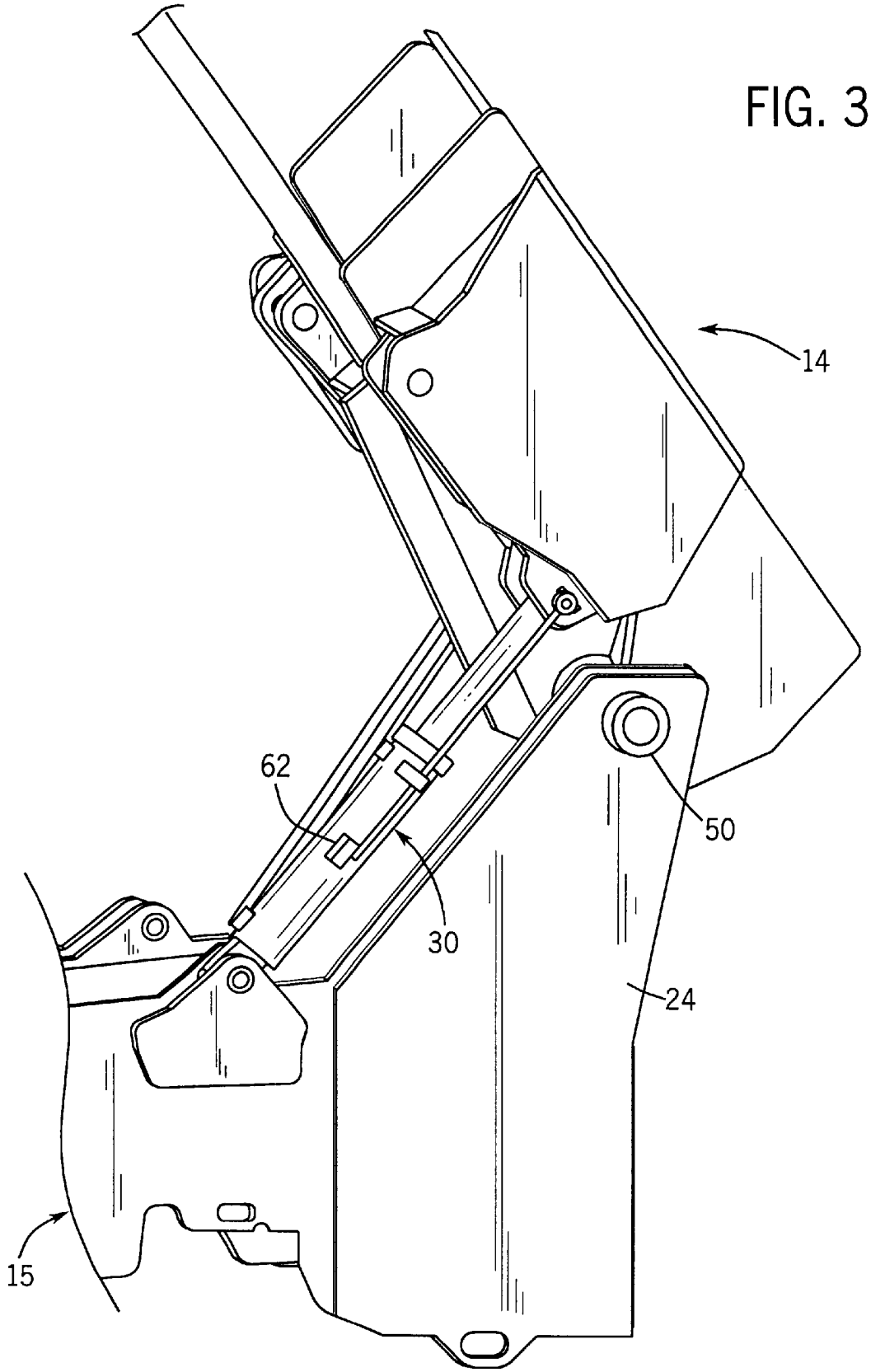
FIG. 3 is a view similar to FIG. 2, showing the boom in a raised position relative to the frame.

FIGS. 2 and 3 illustrate a position sensing arrangement interposed between boom assembly 14 and central frame member 15 for detecting when the angle of boom assembly 14 relative to chassis 12 reaches a predetermined threshold. Referring to FIG. 2, the position sensing arrangement includes a rod 54 mounted to a plate 56 through a pivotable mounting arrangement 58. Plate 56 is one of a pair of such plates mounted to the underside of boom assembly 14, and the rod of one of slave cylinders 30 is pivotably mounted to and between the plates such as 56. Rod 54 extends through a guide member 60 mounted to the cylinder end of slave cylinder 30. A proximity switch 62 is also mounted to the cylinder end of slave cylinder 30, below guide member 60.

FIG. 3 illustrates boom assembly 14 raised relative to central frame member 15 by operation of lift cylinders 26. Such movement of boom assembly 14 results in extension of slave cylinders 30, which causes rod 54 to be moved within guide member 60 along with the rod of slave cylinder 30. That is, rod 54 moves along with the rod of slave cylinder 30, and guide member 60 functions to maintain the longitudinal axis of rod 54 parallel to the longitudinal axis of slave cylinder 30. When boom assembly 14 attains a predetermined angle relative to central frame member 15, the end of rod 54 reaches proximity switch 62, which is then actuated to in turn initiate the brake actuator mechanism and the frame leveling speed control of the present invention. In a representative embodiment, the predetermined angle of boom assembly 14 relative to central frame member 15 may be 60°, although it is understood that any angle as desired could be selected.

Figure 4:
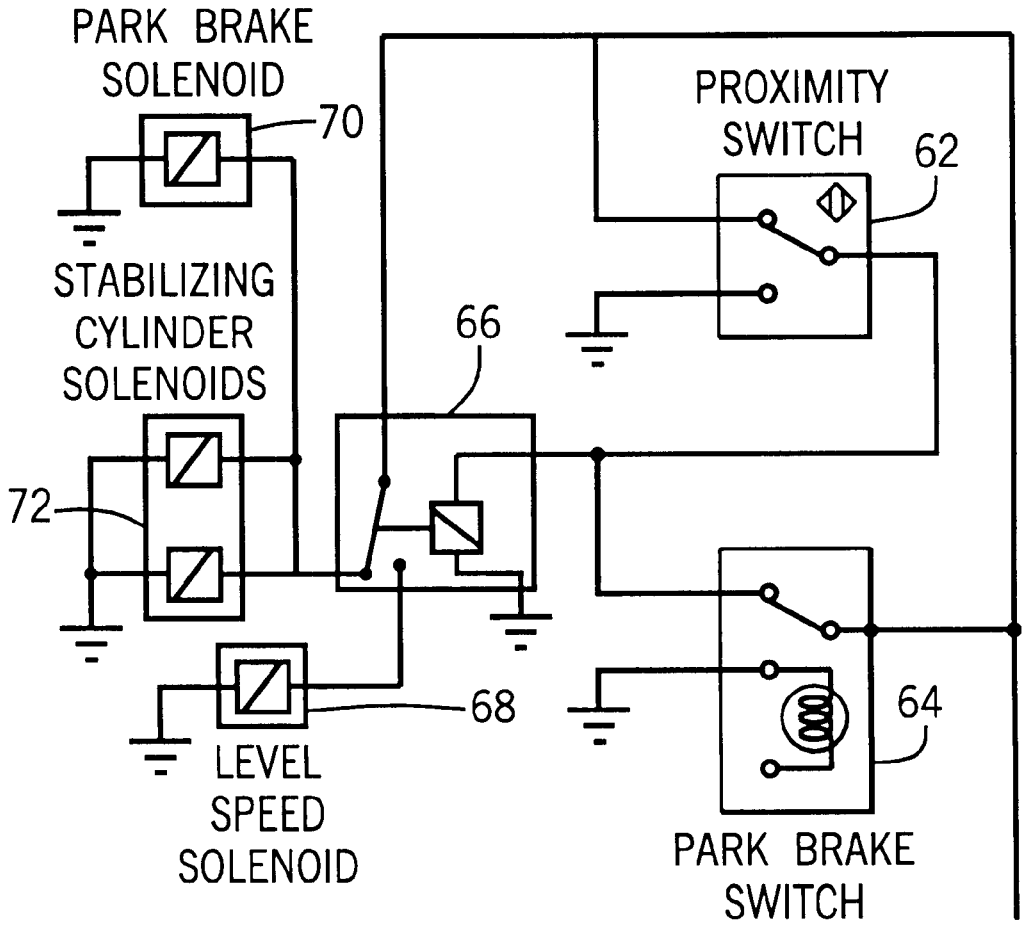
FIG. 4 is a schematic view illustrating the brake actuator in accordance with the present invention, as incorporated into the extendible boom vehicle of FIG. 1.

FIG. 4 is a partial schematic diagram of the electrical system of forklift 10 interconnected with proximity switch 62. As shown in FIG. 4, the electrical system includes a parking brake switch 64 and a relay 66. In turn, relay 66 is interconnected with a level speed control solenoid 68, a parking brake actuator solenoid 70, and a pair of stabilizing cylinder solenoids 72. In operation, when proximity switch 62 is opened by movement of the end of rod 54 over proximity switch 62, proximity switch 62 functions to actuate relay 66 and to simultaneously actuate parking brake switch 64 to engage the parking brake of forklift 10. Alternatively, manual actuation of parking brake switch 64 by the operator functions to actuate relay 66. When this occurs, power is supplied to level speed control solenoid 68 and power is cut off to parking brake solenoid 70 and stabilizing cylinder solenoids 72.

Figure 5:
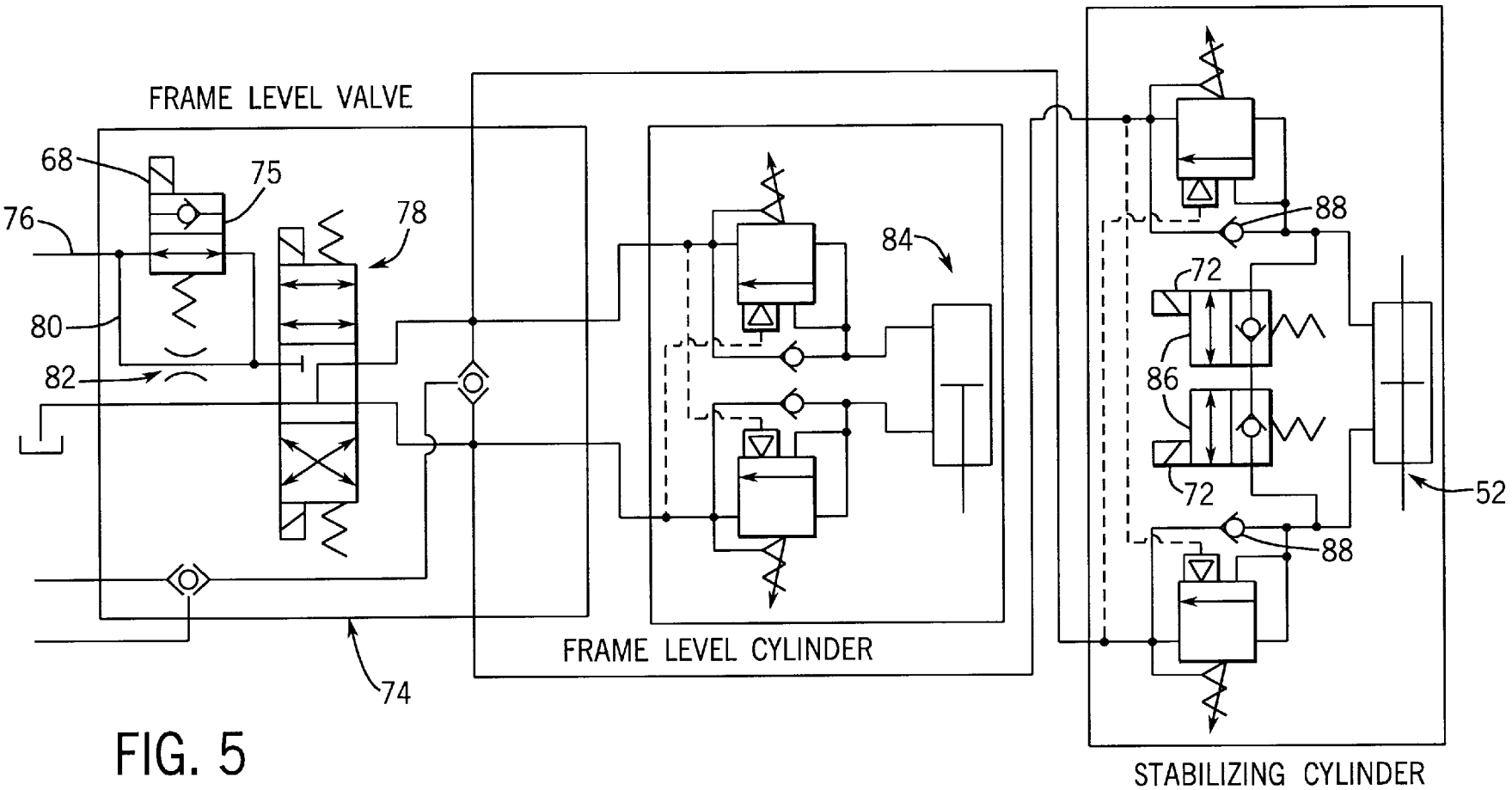
FIG. 5 is a hydraulic circuit diagram illustrating the leveling speed control mechanism in accordance with the present invention, incorporated into the extendible boom vehicle of FIG. 1.

FIG. 5 illustrates a portion of the hydraulic circuit of forklift 10 containing level speed control solenoid 68 and stabilizing cylinder solenoids 72. Level speed control solenoid 68 is interconnected in a frame leveling valve, shown schematically at 74, and controls the position of a level speed control valve 75. Level speed control valve 75 is connected in a line 76, which in turn is connected to a three-position four-way leveling frame control valve 78 through a line 80. A flow restrictor 82 is positioned in branch line 80.

Level speed control valve 75 is spring-biased toward a normal flow position, as shown in FIG. 5. Upon actuation of level speed control solenoid 68 as described above, level speed control valve 75 is forced to a check position, in which the flow of fluid in line 76 is cut off and fluid is supplied to frame leveling valve 78 through line 80 and flow restrictor 82. When this occurs, a reduced flow of fluid is supplied to the frame leveling cylinder, shown in FIG. 5 at 84, thereby slowing the speed of leveling of forklift 10 when boom assembly 14 is above the predetermined angle relative to central frame member 15. Illustratively, flow restrictor 82 may provide approximately a 90% reduction in fluid flow to frame leveling cylinder 84.

As noted previously, power to stabilizing cylinder solenoids 72 is cut off when boom assembly 14 is above the predetermined angle relative to central frame member 15. When this occurs, a pair of stabilizing cylinder control valves 86, (FIG. 5,) are spring-biased from a flow position, which provides normal operation of stabilizing cylinder 52, to a check position, as shown in FIG. 5, which combines with check valves 88 to prevent fluid from flowing into or out of stabilizing cylinder 52. This functions to lock stabilizing cylinder 52 in position so as to prevent movement of stabilizing cylinder 52 when leveling cylinder 84 is being operated in response to leveling control valve 78.

With this system, movement of boom assembly 14 to a predetermined angle relative to central frame member 15 automatically results in application of the parking brake of forklift 10, locking of stabilizing cylinder 52 and actuation of level speed control valve 75 to restrict the flow of fluid to frame leveling cylinder 84, to prevent movement of fork lift 10 and to provide slow frame leveling when boom assembly 14 is raised above the predetermined angle. In addition, stabilizing cylinder 52 is locked and level speed control valve 75 is actuated upon manual engagement of the vehicle's parking brake, regardless of the position of boom assembly 14 relative to central frame member 15.

Various alternatives and embodiments are contemplated as being within the scope of the following claims particularly pointing out and distinctly claiming the subject matter regarded as the invention.

I claim:

1. A boom-type vehicle, comprising:

a frame carrying a set of ground-engaging wheels;

a stabilizing cylinder interposed between the frame and the wheels for cushioning shocks caused by movement of the wheels relative to the frame;

a frame leveling arrangement interposed between the frame and the wheels for leveling the frame relative to the ground;

a boom pivotably mounted to the frame; and a position sensing arrangement interposed between the boom and the frame for sensing the angle of the boom relative to the frame;

wherein the frame leveling arrangement includes a leveling speed control responsive to the position sensing arrangement for enabling the frame leveling arrangement to operate at a first speed of operation when the angle of the boom relative to the frame is below a predetermined threshold, and to operate at a second speed of operation less than the first speed when the angle of the boom relative to the frame is above the predetermined threshold.

2. The boom-type vehicle of claim 1, further comprising a parking brake for selectively preventing rotation of the wheels relative to the frame, and a parking brake actuator responsive to the position sensing arrangement for applying the parking brake when the angle of the boom relative to the frame is above the predetermined threshold.

3. The boom-type vehicle of claim 1, wherein a cylinder arrangement is interconnected between the boom and the frame for providing pivoting movement of the boom relative to the frame.

4. The boom-type vehicle of claim 3, wherein the position sensing arrangement comprises a movable member interconnected with the boom and movable in response to movement of the boom relative to the frame, and a sensing member mounted to a portion of the cylinder arrangement interconnected with the frame, wherein the position of the movable member relative to the sensing member changes according to the angle of the boom relative to the frame.

5. A boom-type vehicle, comprising:

a frame carrying a set of ground-engaging wheels;

a frame leveling arrangement interposed between the frame and the wheels for leveling the frame relative to the ground;

a boom pivotably mounted to the frame and a cylinder arrangement interconnected between the boom and the frame for providing pivoting movement of the boom relative to the frame; and a position sensing arrangement interposed between the boom and the frame for sensing the angle of the boom relative to the frame, wherein the position sensing arrangement comprises a rod member interconnected with the boom and movable in response to movement of the boom relative to the frame, wherein the rod member has a first end pivotably interconnected with the boom and a second end spaced therefrom, and a proximity switch mounted to a portion of the cylinder arrangement interconnected with the frame, wherein the position of the rod member relative to the proximity switch changes according to the angle of the boom relative to the frame, wherein the proximity switch is operable to detect the second end of the rod member when the angle of the boom relative to the frame reaches a predetermined threshold;

wherein the frame leveling arrangement includes a leveling speed control responsive to the position sensing arrangement for enabling the frame leveling arrangement to operate at a first speed of operation when the angle of the boom relative to the frame is below the predetermined threshold, and to operate at a second speed of operation less than the first speed when the angle of the boom relative to the frame is above the predetermined threshold.

6. The boom-type vehicle of claim 1, wherein the frame leveling arrangement comprises a hydraulic cylinder arrangement interconnected between the frame and the wheels, and wherein the leveling speed control comprises a shiftable member interconnected with the hydraulic cylinder arrangement, wherein the shiftable member is operable to direct fluid to the hydraulic cylinder arrangement through a flow restrictor when the position sensing arrangement senses that the angle of the boom relative to the frame is above the predetermined threshold.

7. The boom-type vehicle of claim 6, wherein the shiftable member comprises a valve and wherein the position sensing arrangement comprises a switch mechanism interconnected with the valve for shifting the valve to direct fluid flow to the hydraulic cylinder arrangement through the flow restrictor in response to movement of the boom past a predetermined boom angle relative to the frame.

8. A boom-type vehicle, comprising:

a frame;

a set of ground-engaging wheels interconnected with the frame;

a frame leveling arrangement interposed between the frame and the wheels for leveling the frame relative to the ground;

a brake interconnected with the wheels;

a boom pivotably mounted to the frame;

a position sensing arrangement interposed between the boom and the frame for sensing the angle of the boom relative to the frame; and a control arrangement responsive to the position sensing arrangement, wherein the control arrangement is operable to enable operation of the frame leveling arrangement at a first speed of operation when the angle of the boom relative to the frame is below a predetermined threshold, and wherein the control arrangement is operable to apply the brake to prevent movement of the vehicle and to restrict the speed of operation of the leveling arrangement to a second speed of operation less than the first speed when the angle of the boom relative to the frame is above the predetermined threshold.

9. The boom-type vehicle of claim 8, wherein the frame leveling arrangement comprises at least one extendible and retractable frame leveling cylinder assembly interposed between the wheels and the frame, and wherein the control arrangement comprises a flow restricting arrangement adapted for selective placement in a fluid flow path including the frame leveling cylinder in response to the position sensing arrangement.

10. The boom-type vehicle of claim 9, wherein the flow restricting arrangement comprises a first flow restrictor for restricting the flow of hydraulic fluid to and from the frame leveling cylinder.

11. The boom-type vehicle of claim 9, wherein the position sensing arrangement comprises a switch device which is actuated when the angle of the boom relative to the frame exceeds the predetermined threshold, wherein the switch device is interconnected with the flow restricting arrangement for placing the flow restricting arrangement in the fluid flow path.

12. A boom-type vehicle, comprising:

a brake interconnected with the wheels for selectively preventing rotation of the wheels relative to the frame;

a frame leveling arrangement interposed between the frame and the wheels for leveling the frame relative to the ground;

a boom pivotably mounted to the frame;

a position sensing arrangement interposed between the boom and the frame for sensing the angle of the boom relative to the frame; and a brake actuator responsive to the position sensing arrangement for applying the brake when the angle of the boom relative to the frame exceeds a predetermined threshold.

13. The boom-type vehicle of claim 12, wherein the frame leveling arrangement includes a leveling speed control responsive to the position sensing arrangement for enabling the leveling arrangement to operate a first speed of operation when the angle of the boom relative to the frame is below the predetermined threshold, and to operate at a second speed of operation less than the first speed when the angle of the boom relative to the frame is above the predetermined threshold.

14. The boom-type vehicle of claim 13, wherein the position sensing arrangement comprises a switch device which is actuated when the angle of the boom relative to the frame exceeds the predetermined threshold, wherein the switch device is interconnected with the brake actuator.

15. The boom-type vehicle of claim 14, wherein the frame leveling arrangement comprises at least one frame leveling cylinder interposed between the wheels and the frame, and wherein the leveling speed control comprises a flow restricting arrangement shiftable into the fluid flow path of the frame leveling cylinder in response to the switch device for restricting the flow of fluid to and from the frame leveling cylinder when the angle of the boom relative to the frame exceeds the predetermined threshold.

16. A method of operating a boom-type vehicle having a frame, a set of ground-engaging wheels mounted to the frame, a frame leveling arrangement interposed between the frame and the wheels, a brake interconnected with the wheels, and a boom pivotably mounted to the frame, comprising the steps of:

sensing the angle of the boom relative to the frame;

enabling operation of the frame leveling arrangement at a first speed when the angle of the boom relative to the frame is below a predetermined threshold; and automatically applying the brake and enabling operation of the frame leveling arrangement at a second speed less than the first speed when the angle of the boom relative to the frame is above the predetermined threshold.

17. The method of claim 16, wherein the frame leveling arrangement comprises at least one fluid-operated frame leveling cylinder, and wherein the step of enabling operation of the frame leveling arrangement at a second speed less than the first speed is carried out by positioning a flow restrictor in the fluid flow path of the frame leveling cylinder when the angle of the boom relative to the frame is above the predetermined threshold.

18. The method of claim 17, wherein the step of sensing the angle of the boom relative to the frame is carried out by a switch device which is actuated when the angle of the boom relative to the frame is above the predetermined threshold, and wherein the steps of automatically applying the brake and enabling operation of the frame leveling arrangement at the second speed are carried out in response to actuation of the switch device.

19. A boom-type vehicle, comprising:

a frame carrying a set of ground-engaging wheels;

a frame leveling arrangement interposed between the frame and the wheels for leveling the frame relative to the ground, wherein the frame leveling arrangement is operable to vary the angular position of the frame relative to the wheels when the vehicle is stationary;

a boom pivotably mounted to the frame; and a position sensing arrangement interposed between the boom and the frame for sensing the angle of the boom relative to the frame;

wherein the frame leveling arrangement includes a leveling speed control responsive to the position sensing arrangement for enabling the frame leveling arrangement to operate at a first speed of operation when the angle of the boom relative to the frame is below a predetermined threshold, and to operate at a second speed of operation less than the first speed when the angle of the boom relative to the frame is above the predetermined threshold.

20. The boom-type vehicle of claim 19, further comprising a parking brake for selectively preventing rotation of the wheels relative to the frame, and a parking brake actuator responsive to the position sensing arrangement for applying the parking brake when the angle of the boom relative to the frame is above the predetermined threshold.

21. The boom-type vehicle of claim 19, wherein a cylinder arrangement is interconnected between the boom and the frame for providing pivoting movement of the boom relative to the frame.

22. The boom-type vehicle of claim 21, wherein the position sensing arrangement comprises a movable member interconnected with the boom and movable in response to movement of the boom relative to the frame, and a sensing member mounted to a portion of the cylinder arrangement interconnected with the frame, wherein the position of the movable member relative to the sensing member changes according to the angle of the boom relative to the frame.

23. The boom-type vehicle of claim 19, wherein the frame leveling arrangement comprises a hydraulic cylinder arrangement interconnected between the frame and the wheels, and wherein the leveling speed control comprises a shiftable member interconnected with the hydraulic cylinder arrangement, wherein the shiftable member is operable to direct fluid to the hydraulic cylinder arrangement through a flow restrictor when the position sensing arrangement senses that the angle of the boom relative to the frame is above the predetermined threshold.

24. The boom-type vehicle of claim 23, wherein the shiftable member comprises a valve and wherein the position sensing arrangement comprises a switch mechanism interconnected with the valve for shifting the valve to direct fluid flow to the hydraulic cylinder arrangement through the flow restrictor in response to movement of the boom past a predetermined boom angle relative to the frame.

* * * * *